US010739069B2

(12) United States Patent
Komaki et al.

(10) Patent No.: US 10,739,069 B2
(45) Date of Patent: Aug. 11, 2020

(54) LOW-TEMPERATURE DRYING APPARATUS

(71) Applicant: NGK INSULATORS, LTD., Nagoya (JP)

(72) Inventors: Takeshi Komaki, Nagoya (JP); Taiki Kinnan, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 28 days.

(21) Appl. No.: 16/141,040

(22) Filed: Sep. 25, 2018

(65) Prior Publication Data

US 2019/0024972 A1 Jan. 24, 2019

Related U.S. Application Data

(63) Continuation of application No. PCT/JP2017/010404, filed on Mar. 15, 2017.

(30) Foreign Application Priority Data

Mar. 28, 2016 (JP) ..... 2016-063626

(51) Int. Cl.
*F26B 3/30* (2006.01)
*F26B 21/00* (2006.01)
(Continued)

(52) U.S. Cl.
CPC ..... *F26B 3/30* (2013.01); *F26B 13/00* (2013.01); *F26B 21/004* (2013.01); *F26B 23/04* (2013.01)

(58) Field of Classification Search
CPC .. F26B 13/00; F26B 3/30; F26B 23/04; F26B 21/004
(Continued)

(56) References Cited

U.S. PATENT DOCUMENTS 2,419,643 A * 4/1947 Hudson ..... F26B 3/30 219/410
2,478,001 A * 8/1949 Miskella ..... F26B 3/30 219/395
(Continued)

FOREIGN PATENT DOCUMENTS

CN 103328115 A 9/2013
CN 104756599 A 7/2015
(Continued)

OTHER PUBLICATIONS

Chinese Office Action (Application No. 201780020350.6) dated Nov. 4, 2019 (with English translation).
(Continued)

*Primary Examiner* — Stephen M Gravini
(74) *Attorney, Agent, or Firm* — Burr & Brown, PLLC

(57) ABSTRACT

A low-temperature drying apparatus includes a furnace body, an object holder, an infrared light transmitting plate, a supply device, a discharge device, and infrared heaters. The object holder holds an object to be dried so that the object to be dried is placed in the furnace body. The infrared light transmitting plate is arranged on a surface of the furnace body that faces the object holder. The cooling flow generating device generates a cooling flow in a space between the object to be dried that is held by the object holder and the infrared light transmitting plate. The infrared heater is disposed to face the infrared light transmitting plate in an open space outside the furnace body.

4 Claims, 4 Drawing Sheets

(51) Int. Cl.
*F26B 23/04* (2006.01)
*F26B 13/00* (2006.01)

(58) Field of Classification Search
USPC ..... 34/266
See application file for complete search history.

(56) References Cited

U.S. PATENT DOCUMENTS

| | | | | | |
|---|---|---|---|---|---|
| 3,900,959 | A * | 8/1975 | Breschi | F26B 3/283 | 34/639 |
| 4,501,072 | A * | 2/1985 | Jacobi, Jr. | F26B 3/283 | 101/488 |
| 5,155,798 | A * | 10/1992 | Van Denend | H05B 3/009 | 338/234 |
| 5,319,861 | A * | 6/1994 | Tate | F26B 3/30 | 34/267 |
| 6,161,304 | A * | 12/2000 | Iaccino | F26B 15/18 | 34/208 |
| 7,363,729 | B2 * | 4/2008 | Tanaka | F26B 3/28 | 205/333 |
| 8,038,436 | B2 * | 10/2011 | Rogers, Jr. | F26B 13/12 | 34/464 |
| 8,904,668 | B2 * | 12/2014 | Priebe | F26B 3/22 | 101/450.1 |
| 8,984,764 | B2 * | 3/2015 | Rae | B41F 23/0409 | 101/424.1 |
| 9,188,386 | B2 | 11/2015 | Fujita et al. | | |
| 9,651,303 | B2 * | 5/2017 | Vinyard | F27B 9/16 | |
| 9,841,234 | B2 * | 12/2017 | Stahl | F26B 3/283 | |
| 10,139,159 | B2 * | 11/2018 | Zagar | B41F 23/0413 | |
| 10,260,811 | B2 * | 4/2019 | Rohner | A61C 13/20 | |
| 2006/0040063 | A1 * | 2/2006 | Zoppas | B05D 1/18 | 427/430.1 |
| 2011/0067260 | A1 | 3/2011 | Kim et al. | | |
| 2013/0219738 | A1 | 8/2013 | Fujita et al. | | |
| 2015/0226479 | A1 * | 8/2015 | Fujita | F26B 3/30 | 34/266 |
| 2015/0354892 | A1 | 12/2015 | Fujita et al. | | |
| 2016/0157300 | A1 | 6/2016 | Komaki et al. | | |
| 2019/0024972 | A1 * | 1/2019 | Komaki | F26B 23/04 | |

FOREIGN PATENT DOCUMENTS

| | | | | |
|---|---|---|---|---|
| EP | 3438588 | A1 * | 2/2019 | F26B 13/00 |
| GB | 1357789 | A * | 6/1974 | H05B 3/0038 |
| JP | S55-158485 | A1 | 12/1980 | |
| JP | 3897456 | B2 | 3/2007 | |
| JP | 2010-101595 | A1 | 5/2010 | |
| JP | 2013-057438 | A1 | 3/2013 | |
| JP | 2014-181889 | A1 | 9/2014 | |
| JP | 5721897 | B1 | 5/2015 | |
| JP | WO2017169784 | A1 * | 4/2018 | F26B 13/00 |
| JP | 6368436 | B2 * | 8/2018 | F26B 21/004 |
| TW | 201510451 | A | 3/2015 | |
| WO | 2010/141587 | A1 | 12/2010 | |
| WO | 2013/111511 | A1 | 8/2013 | |
| WO | 2014/073289 | A1 | 5/2014 | |
| WO | 2014/132952 | A1 | 9/2014 | |
| WO | 2014/168229 | A1 | 10/2014 | |
| WO | WO-2017169784 | A1 * | 10/2017 | F26B 3/30 |

OTHER PUBLICATIONS

Extended European Search Report (Application No. 17774328.3) dated Oct. 18, 2019.
International Search Report and Written Opinion (Application No. PCT/JP2017/010404) dated Jun. 6, 2017.
Japanese Office Action (Application No. 2017-545970) dated Oct. 24, 2017.
Japanese Office Action (Application No. 2017-545970) dated Mar. 13, 2018.
English translation of International Preliminary Report on Patentability (Chapter I) (Application No. PCT/JP2017/010404) dated Oct. 11, 2018.
Chinese Office Action (with English translation), Chinese Application No. 201780020350.6, dated Mar. 16, 2020 (14 pages).

* cited by examiner

LOW-TEMPERATURE DRYING APPARATUS

BACKGROUND OF THE INVENTION

1. Field of the Invention

The present invention relates to a low-temperature drying apparatus.

2. Description of the Related Art

An example of a known drying apparatus includes a furnace body, a movable body that moves through an interior space of the furnace body with an object to be dried placed thereon, an infrared heater disposed in an upper section of the interior space of the furnace body, and a gas supplying device that supplies gas with regulated temperature and humidity to the interior space of the furnace body (see PTL 1). Another example of this type of drying apparatus includes an infrared light transmitting plate that divides an interior space of a furnace body into a first space containing a movable body and a second space containing an infrared heater. Gas with regulated temperature and humidity is caused to pass through the first space (see PTL 2).

CITATION LIST

Patent Literature

PTL 1: JP 3897456
PTL 2: WO 2014/132952 A1

SUMMARY OF THE INVENTION

However, since each of the above-described drying apparatuses includes the infrared heater disposed in the interior space of the furnace body, light with wavelengths unnecessary to dry the object to be dried is absorbed by furnace walls and causes an increase in the temperature of the furnace walls. Accordingly, the temperature in the furnace increases. Some objects to be dried have a low allowable upper temperature limit. In such a case, there is a risk that the furnace atmosphere temperature will exceed the upper temperature limit.

The present invention has been made to solve the above-described problem, and the main object of the present invention is to enable efficient drying of an object to be dried without exceeding an allowable upper temperature limit thereof even when the upper temperature limit is low.

A low-temperature drying apparatus according to the present invention includes a furnace body; an object holder that holds an object to be dried so that the object to be dried is placed in the furnace body; an infrared light transmitting plate arranged on a surface of the furnace body that faces the object holder; and a cooling flow generating device that generates a cooling flow in a space between the object to be dried that is held by the object holder and the infrared light transmitting plate; and an infrared heater disposed to face the infrared light transmitting plate in an open space outside the furnace body.

According to the low-temperature drying apparatus, no furnace walls are provided around the infrared heater. Thus, there are no furnace walls that are heated to a high temperature by absorbing light having a wavelength unnecessary to dry the object to be dried. Therefore, the atmosphere temperature in the furnace body can be prevented from becoming excessively high. In addition, since the cooling flow passes through the space between the object to be dried and the infrared light transmitting plate, the temperature of the object to be dried and the holder thereof can be maintained relatively low, and the temperature of the infrared light transmitting plate can be maintained low. Therefore, the object to be dried can be efficiently dried without exceeding the allowable upper temperature limit thereof even when the upper temperature limit is low.

The low-temperature drying apparatus according to the present invention may further include a temperature reducing device that reduces a temperature around the infrared heater. The space around the infrared heater is heated by the infrared heater, but the temperature therein is reduced by the temperature reducing device. Although the gas around the infrared heater is in contact with the infrared light transmitting plate, since the temperature of the gas is reduced, the temperature of the infrared light transmitting plate can be reliably maintained low.

In the low-temperature drying apparatus according to the present invention, the cooling flow generating device includes a supply hole and a discharge hole for the cooling flow, and the supply hole and the discharge hole are thin slits that extend along a plate surface of the infrared light transmitting plate. In such a case, the cooling flow easily travels along the plate surface of the infrared light transmitting plate, and therefore the infrared light transmitting plate can be efficiently cooled.

In the low-temperature drying apparatus according to the present invention, at least a side surface of the furnace body is a metal surface having no heat-insulating material. In such a case, even when the furnace atmosphere temperature starts to increase, heat can be easily dissipated through the metal surface having no heat-insulating material. Accordingly, the furnace atmosphere temperature can be maintained low.

DETAILED DESCRIPTION OF THE INVENTION

Figure 1:
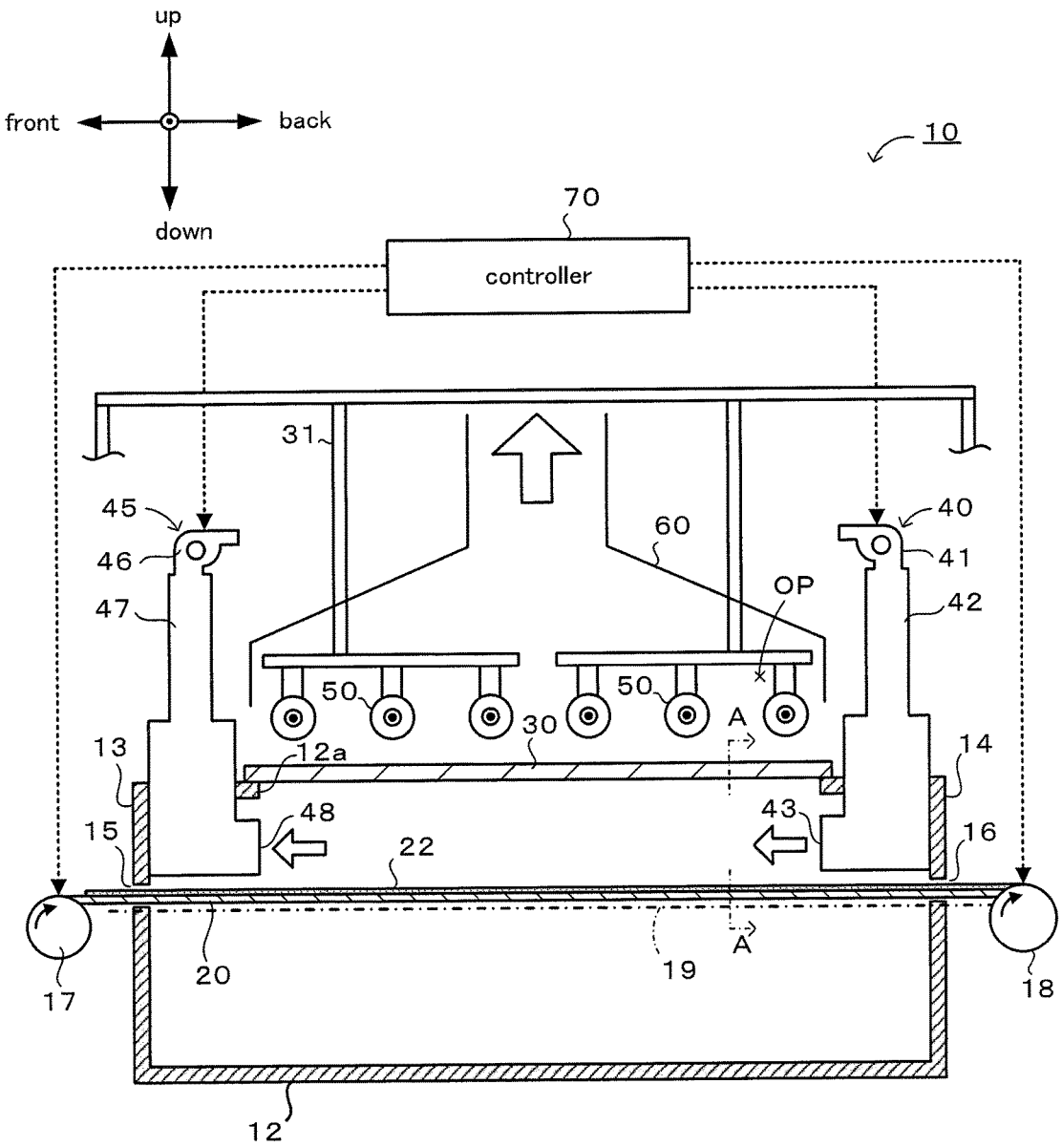
FIG. 1 is a schematic longitudinal sectional view illustrating the structure of a low-temperature drying apparatus 10.
Figure 2:
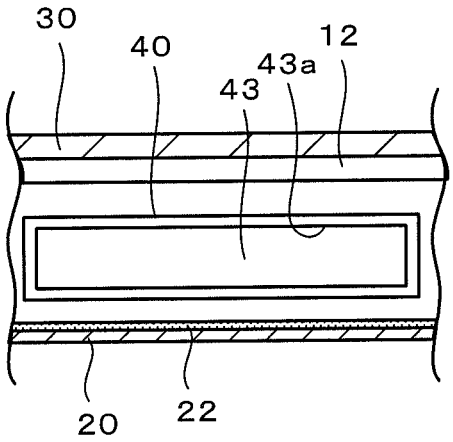
FIG. 2 is a sectional view taken along line A-A in FIG. 1.

An embodiment of the present invention will now be described with reference to the drawings. FIG. 1 is a schematic longitudinal sectional view illustrating the structure of a low-temperature drying apparatus 10 according to the embodiment of the present invention. FIG. 2 is a sectional view taken along line A-A in FIG. 1. For convenience of description, the front-back and up-down directions of the low-temperature drying apparatus 10 are defined as shown in FIG. 1, and the left-right direction of the low-temperature drying apparatus 10 is defined as the direction perpendicular to the plane of FIG. 1 (near and far sides with respect to the plane are right and left, respectively).

The low-temperature drying apparatus 10 includes a furnace body 12, a sheet 20, an infrared light transmitting plate 30, a supply device 40, a discharge device 45, infrared heaters 50, a heater duct 60, and a controller 70. The low-temperature drying apparatus 10 also includes a roll 17 disposed in front of the furnace body 12 and a roll 18 disposed behind the furnace body 12. The low-temperature drying apparatus 10 is configured as a roll-to-roll drying apparatus in which the sheet 20 having a coating film 22 on the top surface thereof is dried while being continuously conveyed by the rolls 17 and 18.

The furnace body 12 is used to dry the coating film. The furnace body 12 is a substantially rectangular-parallelepiped-shaped structure, and a front surface 13, a back surface 14, and left and right side surfaces (not shown) thereof are metal surfaces having no heat-insulating material. The metal surfaces may be made of any highly heat conductive metal, such as stainless steel or anodized aluminum. The metal surfaces may have columns and beams to ensure sufficient structural strength. The infrared light transmitting plate 30 is fitted to the top surface of the furnace body 12 at a position where the infrared light transmitting plate 30 faces the sheet 20. The front surface 13 and the back surface 14 of the furnace body 12 respectively have openings 15 and 16. The openings 15 and 16 serve as entrance and exit holes of the furnace body 12. The length of the furnace body 12 between the front surface 13 and the back surface 14 is, for example, 2 to 10 m. The furnace body 12 includes a conveying passage 19 that extends from the opening 15 to the opening 16. The conveying passage 19 horizontally extends through the furnace body 12. The sheet 20 having the coating film 22 on one side thereof is conveyed along the conveying passage 19.

There is no particular limitation regarding the sheet 20. The sheet 20 is, for example, a resin sheet, and is formed of a PET film in the present embodiment. For example, the sheet 20 has a thickness of 10 to 100 μm and a width (length in the left-right direction) of 200 to 1000 mm, and the length of the sheet 20 in the furnace in the front-back direction is 1000 to 1500 mm. However, the sheet 20 is not particularly limited to this. The coating film 22 is applied to the top surface of the sheet 20, and is used as, for example, a thin film for a multilayer ceramic capacitor (MLCC) after dried. The coating film 22 contains, for example, ceramic or metal powder, an organic binder, and an organic solvent. The thickness of the coating film 22 is not particularly limited, and may be, for example, 20 to 1000 μm.

The infrared light transmitting plate 30 is disposed to cover an opening 12*a* formed in the top surface of the furnace body 12, and faces the sheet 20 that holds the coating film 22. The infrared light transmitting plate 30 is made of, for example, quartz glass or borosilicate crown glass, and functions as a filter that transmits infrared light having a wavelength of 3.5 μm or less and absorbs infrared light having a wavelength greater than 3.5 μm. The material of the infrared light transmitting plate 30 is preferably the same as the material of an inner tube 53 and an outer tube 55 of each infrared heater 50, which will be described below. The infrared light transmitting plate is not limited to a plate that transmits infrared light having a wavelength of 3.5 μm or less, and may instead be a plate that transmits infrared light having a long wavelength, for example, a wavelength of 6 μm.

The supply device 40 is a device that supplies (blows) fluid along a surface of the sheet 20 to cool the coating film 22 and the sheet 20, which pass through the furnace body 12, and the infrared light transmitting plate 30. The supply device 40 includes a supply fan 41, a pipe structure 42, and a supply hole 43. The supply fan 41 is attached to the pipe structure 42, and introduces fluid into the pipe structure 42. The fluid is a cold flow that is capable of cooling the sheet 20, and is, for example, air at a normal temperature or 50° C. or less. The supply fan 41 is capable of adjusting the flow rate and temperature of the fluid. The pipe structure 42 serves as a passage for the fluid from the supply fan 41. The pipe structure 42 defines a passage that extends from the supply fan 41 to the inside of the furnace body 12 through the ceiling of the furnace body 12. The supply hole 43 serves as an inlet through which the fluid from the supply fan 41 is supplied to the furnace body 12. The supply hole 43 is disposed near the opening 16 through which the sheet 20 is conveyed out of the furnace body 12, and faces the opening 15 through which the sheet 20 is conveyed into the furnace body 12. As illustrated in FIG. 2, the supply hole 43 is formed as a thin slit that extends in the left-right direction along the plate surface of the infrared light transmitting plate. The supply device 40 supplies the fluid in a direction opposite to the direction in which the sheet 20 is conveyed (leftward in FIG. 1).

The discharge device 45 is a device that discharges atmospheric gas out of the furnace body 12. The discharge device 45 includes a discharge fan 46, a pipe structure 47, and a discharge hole 48. The discharge hole 48 is disposed near the opening 15 through which the sheet 20 is conveyed into the furnace body 12, and faces the opening 16 through which the sheet 20 is conveyed out of the furnace body 12. Similar to the supply hole 43, the discharge hole 48 is also formed as a thin slit that extends in the left-right direction along the plate surface of the infrared light transmitting plate. The discharge hole 48 is attached to the pipe structure 47, and the atmospheric gas in the furnace body 12 (mainly gas flow from the supply device 40 that has traveled along the surface of the coating film 22) is sucked and guided into the pipe structure 47 through the discharge hole 48. The pipe structure 47 serves as a flow passage through which the atmospheric gas flows from the discharge hole 48 to the discharge fan 46. The pipe structure 47 defines a passage that extends from the discharge hole 48 to the discharge fan 46 through the ceiling of the furnace body 12. The discharge fan 46 is attached to the pipe structure 47, and discharges the atmospheric gas out of the pipe structure 47.

Figure 3:
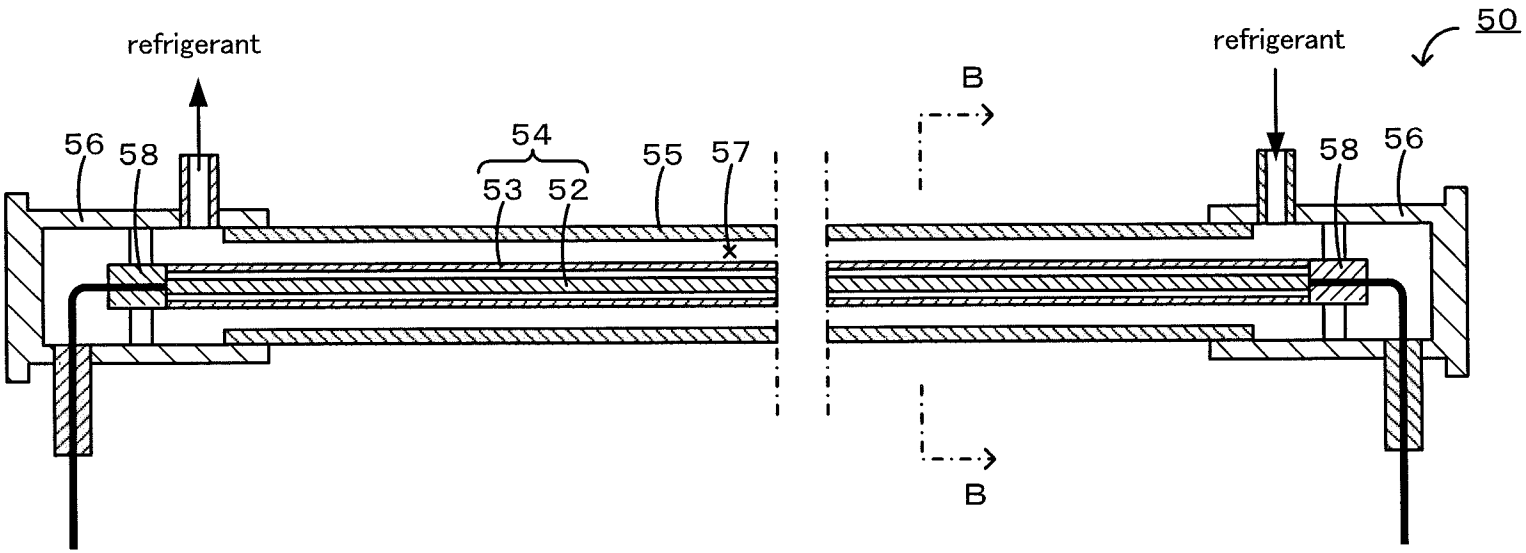
FIG. 3 is a longitudinal sectional view of an infrared heater 50.
Figure 4:
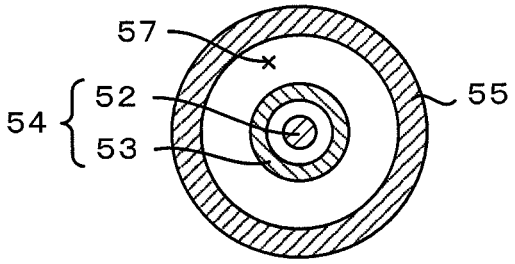
FIG. 4 is a sectional view taken along line B-B in FIG. 3.

The infrared heaters 50 are devices that irradiate the coating film 22, which passes through the furnace body 12, with infrared light through the infrared light transmitting plate 30 from outside the furnace body 12. The infrared heaters 50 are suspended from a frame 31 disposed in an open space OP outside the furnace body 12. The infrared heaters 50 face the infrared light transmitting plate 30. In the present embodiment, the open space OP is a space in a building in which the furnace body 12 is installed. In the present embodiment, a plurality of infrared heaters 50 (six infrared heaters 50 in the present embodiment) are substantially evenly arranged from the front section to the back section of the infrared light transmitting plate 30. The infrared heaters 50 have the same structure, and are arranged such that the longitudinal direction thereof is perpendicular to the direction in which the coating film 22 is conveyed. The structure of each infrared heater 50 will now be described with reference to FIGS. 3 and 4. FIG. 3 is a longitudinal sectional view of the infrared heater 50. FIG. 4 is a sectional view taken along line B-B in FIG. 3.

The infrared heater 50 includes a heater body 54 including a heating element 52 and an inner tube 53 formed so as to surround the heating element 52; an outer tube 55 formed so as to surround the heater body 54; tubular caps 56 having bottoms that are airtightly fitted to both ends of the outer tube 55; and a flow passage 57 that is formed between the heater body 54 and the outer tube 55 and through which refrigerant flows. The heating element 52 radiates infrared light having a peak at a wavelength of around 3 μm when electrically heated to 700° C. to 1200° C. The inner tube 53 is made of, for example, quartz glass or borosilicate crown glass, and functions as a filter that transmits infrared light having a wavelength of 3.5 μm or less and absorbs infrared light having a wavelength greater than 3.5 μm. The heater body 54 is supported by holders 58 disposed in the caps 56 at both ends thereof. Similar to the inner tube 53, the outer tube 55 is also made of, for example, quartz glass or borosilicate crown glass, and functions as a filter that transmits infrared light having a wavelength of 3.5 μm or less and absorbs infrared light having a wavelength greater than 3.5 μm. The flow passage 57 is configured such that the refrigerant flows from an inlet provided in one of the caps 56 to an outlet provided in the other cap 56. The refrigerant that flows through the flow passage 57 is, for example, air or inert gas, and cools the inner tube 53 and the outer tube 55 by coming into contact with the tubes 53 and 55 and removing heat therefrom. When the heating element 52 of the infrared heater 50 radiates infrared light having a peak at a wavelength of around 3 μm, the infrared light having a wavelength of 3.5 μm or less passes through the inner tube 53 and the outer tube 55 and reaches an object to be heated. The infrared light having such a wavelength is said to have excellent ability to break hydrogen bonds in organic solvents, and is capable of efficiently vaporizing organic solvents. The inner tube 53 and the outer tube 55 absorb infrared light having a wavelength greater than 3.5 μm, but are cooled by the refrigerant that flows through the flow passage 57. Therefore, the temperature of the outer surface of the infrared heater 50 can be maintained lower than or equal to 200° C.

The heater duct 60 provides ventilation by discharging the gas around the infrared heaters 50 disposed in the open space OP outside the furnace body 12 to the outside of the building in which the low-temperature drying apparatus 10 is installed. Therefore, the temperature around the infrared heaters 50 can be maintained low.

The controller 70 is configured as a microprocessor which mainly includes a CPU. The controller 70 outputs control signals to the supply fan 41 and the discharge fan 46 to control the temperature and flow rate of the fluid supplied from the supply hole 43 and the amount of discharge from the discharge hole 48. The controller 70 also controls the rotational speeds of the rolls 17 and 18 to adjust the time in which the sheet 20 and the coating film 22 pass through the furnace body 12 and the tension applied to the sheet 20 and the coating film 22. The controller 70 also performs output control for the infrared heaters 50.

An example of the operation of drying the coating film 22 by using the low-temperature drying apparatus 10 structured as described above will now be described. First, the controller 70 rotates the rolls 17 and 18 to start the conveyance of the sheet 20. Thus, the sheet 20 is unwound from the roll 17 disposed at the front end of the low-temperature drying apparatus 10. A coater (not shown) applies the coating film 22 to the top surface of the sheet 20 immediately before the sheet 20 is conveyed into the furnace body 12 through the opening 15. Then, the sheet 20 to which the coating film 22 has been applied is conveyed into the furnace body 12. At this time, the controller 70 controls the supply fan 41, the discharge fan 46, the infrared heaters 50, and other devices. Accordingly, when the sheet 20 passes through the furnace body 12, the coating film 22 formed on the top surface of the sheet 20 is dried by being irradiated with the infrared light emitted from the infrared heaters 50 and transmitted through the infrared light transmitting plate 30. At the same time, the coating film 22, the sheet 20, and the infrared light transmitting plate 30 are cooled by the cold flow from the supply device 40, and solvent that has evaporated from the coating film 22 is discharged through the discharge device 45. During this time, the heater duct 60 discharges the heated gas around the infrared heaters 50 to provide ventilation. As a result of the above-described processes, the coating film 22 is dried and formed into a thin film while the furnace atmosphere temperature is maintained low (for example, at 40° C. or 35° C.), and is conveyed out through the opening 16. This thin film (coating film 22) is wound around the roll 18 disposed at the back end of the furnace body 12 together with the sheet 20. After that, the thin film is removed from the sheet 20 and cut into pieces having predetermined shapes. The cut pieces are stacked together to produce an MLCC.

The correspondence between the components of the present embodiment and components of the present invention will now be described. The low-temperature drying apparatus 10 according to the present embodiment corresponds to a low-temperature drying apparatus according to the present invention. The furnace body 12 according to the present embodiment corresponds to a furnace body according to the present invention. The sheet 20 according to the present embodiment corresponds to an object holder according to the present invention. The infrared light transmitting plate 30 according to the present embodiment corresponds to an infrared light transmitting plate according to the present invention. The supply device 40 and the discharge device 45 according to the present embodiment correspond to a cooling flow generating device according to the present invention. The infrared heaters 50 according to the present embodiment correspond to an infrared heater according to the present invention. The heater duct 60 according to the present embodiment corresponds to a temperature reducing device according to the present invention.

According to the low-temperature drying apparatus 10 of the present embodiment described in detail above, no furnace walls are provided around the infrared heaters 50. Thus, there are no furnace walls that are heated to a high temperature by absorbing light having a wavelength unnecessary to dry the coating film 22. Therefore, the atmosphere temperature in the furnace body 12 can be prevented from becoming excessively high. In addition, since the cooling flow passes through the space between the coating film 22 and the infrared light transmitting plate 30, the temperature of the coating film 22 and the sheet 20 can be maintained relatively low, and the temperature of the infrared light transmitting plate 30 can be maintained low. Therefore, the coating film 22 can be efficiently dried without exceeding the allowable upper temperature limit thereof even when the upper temperature limit is low. In addition, since the infrared heaters 50 are disposed outside the furnace, the furnace capacity can be reduced. Furthermore, even when the temperature of the infrared heaters 50 is increased, the inside of the furnace is hardly affected. Therefore, the output of the infrared heaters 50 can be increased to achieve drying in a shorter time.

The space around the infrared heaters 50 is heated by the infrared heaters 50. However, the gas in this space is replaced by new gas having a low temperature due to ventilation provided by the heater duct 60. Although the gas around the infrared heaters 50 is in contact with the infrared light transmitting plate 30, since the temperature of the gas is reduced, the temperature of the infrared light transmitting plate 30 can be reliably maintained low.

In addition, the supply hole 43 and the discharge hole 48 for the cooling flow are formed as thin slits that extend along the plate surface of the infrared light transmitting plate 30.

Therefore, the cooling flow easily travels along the plate surface of the infrared light transmitting plate 30, and the plate surface of the infrared light transmitting plate 30 can be efficiently cooled.

In addition, the side surfaces of the furnace body 12 are metal surfaces having no heat-insulating material. Therefore, even when the furnace atmosphere temperature starts to increase, heat can be easily dissipated through the metal surfaces having no heat-insulating material. Accordingly, the furnace atmosphere temperature can be maintained low.

The present invention is not limited in any way to the above-described embodiment, and it goes without saying that the present invention may be implemented in various forms within the technical scope thereof.

For example, although a roll-to-roll system in which the sheet 20 is stretched between the two rolls 17 and 18 is employed in the above-described embodiment, the present invention is not limited to this. For example, a batch system may instead be employed. In the batch system, a lid provided on the furnace body 12 is opened, and the object to be dried is placed in the furnace body 12. Then, the lid is closed and a drying process is performed. After that, the lid is opened and the dried object is taken out of the furnace body 12. Alternatively, the object to be dried may be placed directly on the top surface of a conveyor belt that moves from an entrance to an exit, or in a container placed on the top surface of the conveyor belt.

Although the heater duct 60 is provided in the open space OP in the above-described embodiment, an air conditioner that controls the temperature and humidity in the open space OP may be provided instead of the heater duct 60. Also in this case, the temperature of the gas around the infrared heaters 50 can be reduced.

Although the infrared heaters 50 radiate infrared light having a wavelength of 3.5 μm or less in the above-described embodiment, the present invention is not limited to this. The infrared heaters 50 may instead have any appropriate wavelength range in the range of 0.7 to 1000 μm.

Although the coating film 22 is a thin film for an MLCC in the above-described embodiment, the present invention is not limited to this. For example, the coating film 22 may instead be a thin film for a low temperature co-fired ceramic (LTCC) or other green sheets. Alternatively, the coating film 22 may instead be used as a coating film that serves as an electrode of a battery, such as a lithium ion secondary battery. In this case, the coating film 22 may be formed by applying electrode material paste to the sheet 20. The electrode material paste is obtained by, for example, mixing an electrode material (positive electrode active material or negative electrode active material), a binder, and a conductive material together with a solvent. In the case where the coating film 22 is a coating film that serves as an electrode of a battery, the sheet 20 may be a metal sheet made of, for example, aluminum or copper.

In the above-described embodiment, the position of the supply hole 43 in the supply device 40 is not particularly specified. However, to prevent convection heat generated from the coating film 22 when the coating film 22 is processed or heated from flowing upward, the supply hole 43 may be positioned so that an upper portion 43*a* (see FIG. 2) thereof is closer to the infrared light transmitting plate 30 than the midpoint (center point) between the coating film 22 and the infrared light transmitting plate 30 in terms of distance. In such a case, the effects of the present invention can be more reliably achieved.

The present application claims priority based on Japanese Patent Application No. 2016-063626 filed on Mar. 28, 2016, the entire contents of which are incorporated herein.

What is claimed is:

1. A low-temperature drying apparatus comprising:

a furnace body;

an object holder that holds an object to be dried so that the object to be dried is placed in the furnace body;

an infrared light transmitting plate arranged on a surface of the furnace body that faces the object holder;

a cooling flow generating device that generates a cooling flow in a space between the object to be dried that is held by the object holder and the infrared light transmitting plate; and an infrared heater disposed to face the infrared light transmitting plate in an open space outside the furnace body.

2. The low-temperature drying apparatus according to claim 1, further comprising:

a temperature reducing device that reduces a temperature around the infrared heater.

3. The low-temperature drying apparatus according to claim 1, wherein the cooling flow generating device includes an inlet and an outlet for the cooling flow, and wherein the inlet and the outlet are thin slits that extend along a plate surface of the infrared light transmitting plate.

4. The low-temperature drying apparatus according to claim 1, wherein at least a side surface of the furnace body is a metal surface having no heat-insulating material.

* * * * *